United States Patent [19]

Gebhardt et al.

[11] 4,214,409

[45] Jul. 29, 1980

[54] SPACE FRAME CONSTUCTION

[75] Inventors: Dale H. Gebhardt; Carl H. LaLonde, both of Warren, Ohio

[73] Assignee: Van Huffel Tube Corporation, Warren, Ohio

[21] Appl. No.: 846,406

[22] Filed: Oct. 28, 1977

[51] Int. Cl.[2] ..... E04H 12/08

[52] U.S. Cl. ..... 52/127; 52/648

[58] Field of Search ..... 52/655, 648, 649, 650, 52/690, 127, 691, 692, 695, 80, 81; 403/218, 171, 172, 176, 13, 14, 174, 178; 244/123

[56] References Cited

U.S. PATENT DOCUMENTS

| | | | |
|---|---|---|---|
| 2,092,022 | 9/1937 | Rieger | 52/645 |
| 2,687,193 | 8/1954 | Hinze | 52/640 |
| 2,709,975 | 6/1965 | Parker | 52/649 |
| 2,939,554 | 6/1960 | Bolton | 52/650 |
| 2,964,147 | 12/1960 | Fentiman | 52/648 |
| 2,983,071 | 5/1961 | Oliver | 403/174 |
| 3,270,478 | 9/1966 | Attwood | 52/648 |
| 3,513,861 | 5/1970 | Johnson | 135/3 R |
| 3,925,942 | 12/1975 | Hemmelsbach | 52/650 |
| 3,994,111 | 11/1976 | Papayotti | 52/650 |

FOREIGN PATENT DOCUMENTS

| | | | |
|---|---|---|---|
| 117824 | 11/1943 | Australia . | |
| 282965 | 5/1952 | Switzerland | 52/655 |

OTHER PUBLICATIONS

Space Grid Structures by John Borrego, published 1968, pp. 100 & 101.

*Primary Examiner*—John E. Murtagh

[57] ABSTRACT

A space frame construction of generally pentahedron pyramidal modules comprising chord members forming a rectangular base, strut members of closed tube configuration and which converge to form an apex, and flat connector plates at the apex and at the corners of the rectangular base.

4 Claims, 9 Drawing Figures

FIG. 1
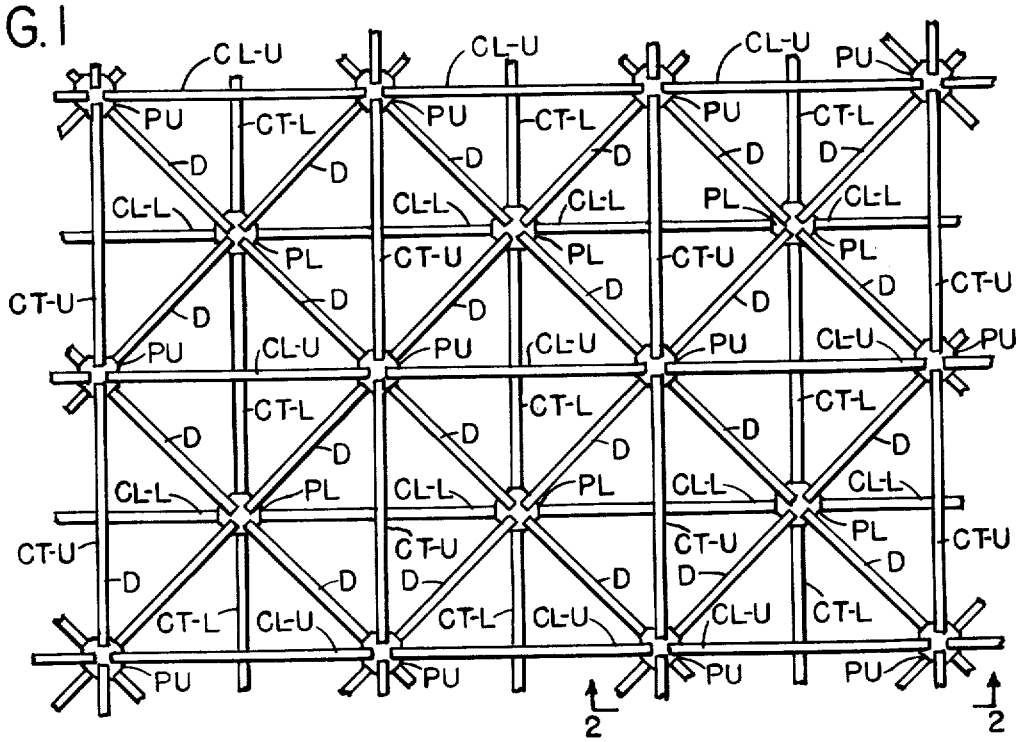
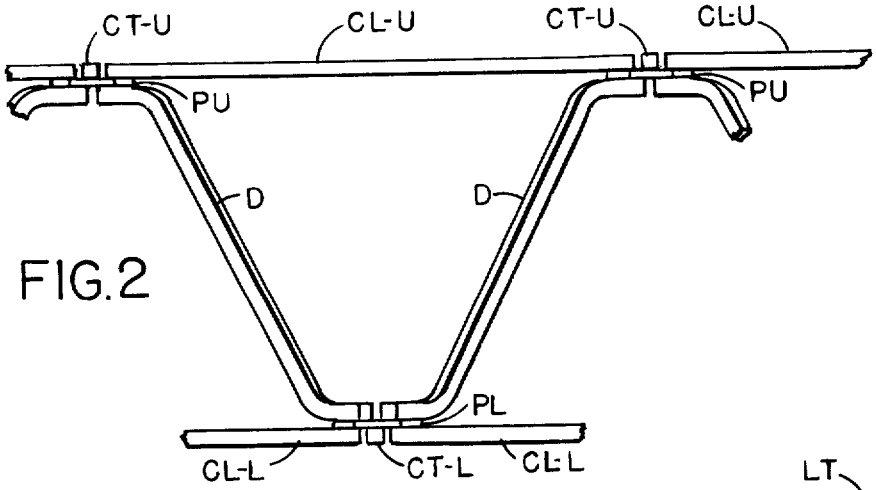
FIG. 2
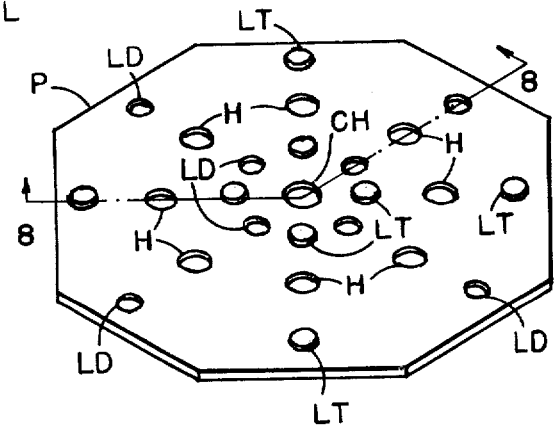
FIG. 3

SPACE FRAME CONSTUCTION

PRIOR ART AND BACKGROUND OF THE INVENTION

In U.S. Pat. No. 3,270,478 to C. W. Attwood there is defined and described "space frame" construction and it is therein acknowledged that the general concept is known to have been contemplated before from the mere geometry viewpoint in U.S. Pat. No. 2,433,677 to H. H. Thomas. The Attwood patent discloses a space frame construction which may be described as being of generally pentahedron pyramidal modular construction comprising open channel chord members, open channel strut members, and fixture plates. The chord and strut members are of straight and equal lengths. The fixtures or connector plates are of a relative complex configuration comprising alternate flat and inclined surfaces for receiving the chord and strut members, with the chord members having the open face of their channel cross-section facing exteriorly of the pyramid form.

The Thomas patent discloses a roof structure comprising a plurality of pyramidal units each comprising straight framing members connected together, at the apex and the base corners, by junction members of general circular tubular cross-sectional shape having laterally directed screwed bosses to which screw couplings are connected.

OBJECTS AND SUMMARY OF THE INVENTION

It is an object of this invention to provide a more simple and facile space frame construction which is resistant to buckling.

It is another object of this invention to provide preformed components which can be easily assembled by unskilled labor to form a space frame construction.

It is a further object of this invention to provide a space frame construction wherein the attachment of roofs, floors, and other structures is facilitated and which provides a more pleasing appearance, in an aesthetic manner, of the open frame structure when viewed from beneath the structure.

Briefly, the objects are attained by and this invention contemplates the provision of diagonal strut members having a special configuration, straight chord members, and generally flat connector plates arranged in a combination which defines a module having a generally pentahedron truncated pyramidal configuration. One or more of the modules, and in some cases even all of them, may be assembled on the ground and then raised into position by a crane or other hoisting means.

DESCRIPTION OF THE DRAWINGS

The invention will be more fully understood and further objects and advantages thereof will become apparent when reference is made to the following detailed description and to the accompanying drawing, in which similar parts bear like reference characters and:

FIG. 1 is a schematic plan view of a plurality of the modules of this invention which are combined to form the space frame construction;

FIG. 2 is a side elevational view taken along line 2—2 of FIG. 1;

FIG. 3 is a three-dimensional view of a connector plate of this invention;

DESCRIPTION OF A PREFERRED EMBODIMENT

Figure 4:
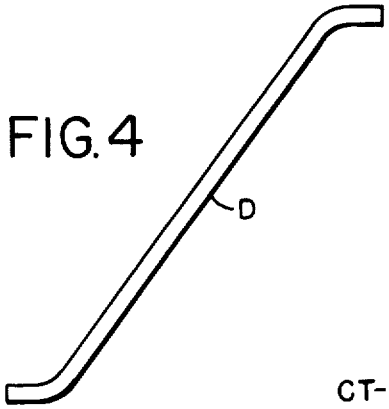
FIG. 4 is a side elevational view of a strut member of this invention.

This invention is particularly adapted for use in the construction of building of roofs with load carrying structural capacity. However, it will be understood that the principles can be applied in any construction wherein the benefits of "space frame" geometry may be utilized. The space frame is adapted for support across a bearing support structure and for long span applications where intermediate supports are not needed.

In a general sense, the space frame of this invention comprises a plurality of substantially parallel chord members, arranged and spaced in upper and lower planes, with the chords of one plane being laterally offset, in alternate fashion, from those in the other plane in both the longitudinal and transverse directions. Substantially flat connector plates are used to interconnect the chord members in each plane and with diagonal strut members. The strut members are closed tubes with distal portions of a tube being smoothly formed from the main body portion to present a generally S-shape configuration, with the distal portions being tubular, as opposed to being closed by flattening, and being, in respect to each other, in parallel planes. In a preferred embodiment, the closed tube chord and strut members have a square cross-sectional configuration. However, it will be understood that closed tubes of other configurations may be used so long as a flat bearing seat is provided at the distal portions for mating with the flat bearing surface of a connector plate; as an example the tube may be circular throughout a major extent of its length but with the distal portions being rectangular.

In a preferred arrangement, four chord members form the base of the structural module, which module is in a general form of a truncated pyramid; the diagonal strut members of the pyramid are comprised of closed tubes; and flat connector plates are at each corner of the base and at the apex of the pyramid.

Referring to FIG. 1 of the drawing, the space frame construction there shown comprises a plurality of laterally spaced chord members CL extending in a direction designated for purpose of description as longitudinal, with the chord members CL in the upper plane being further designated by the suffix U, i.e. CL-U, and those in the lower plane by the suffix L, i.e. CL-L. The chord members CL-U are laterally offset from the chord members CL-L.

There is also shown, in like manner, a plurality of chord members CT extending in a direction transverse to the longitudinal chord members CL. The chord members CT are also arranged in the upper and lower planes and are further designated as CT-U and CT-L, respectively. The diagonal strut members to be later described in more detail are designated by the reference character D.

In a preferred embodiment all of the chord members CL and CT are of a rectangular closed tube configuration and most preferably square. However, in some instances, some of the chord members may be of a U shaped cross-section, such as in selected areas where it is desired to use the space frame as a support for hanging units or apparatus such as lighting fixtures, space heaters, or the like. Usually, in such cases, it will be the lower chord members CL-L and CT-L from which such other items will be suspended and with the open end of the U members facing downward.

Figure 5:
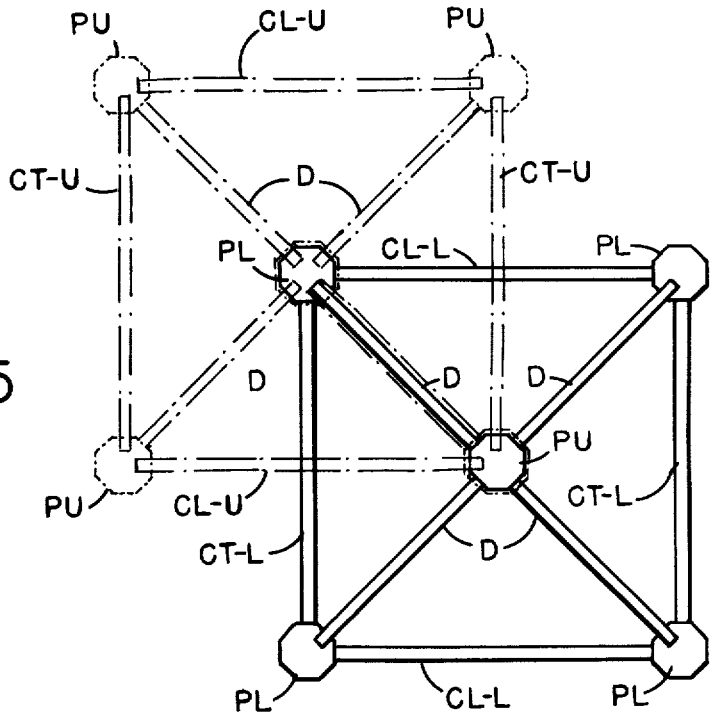
FIG. 5 is a schematic plan view of two modules, with some of the chord members removed to illustrate more clearly the bases of an upright pyramid and an inverted pyramid.
Figure 6:
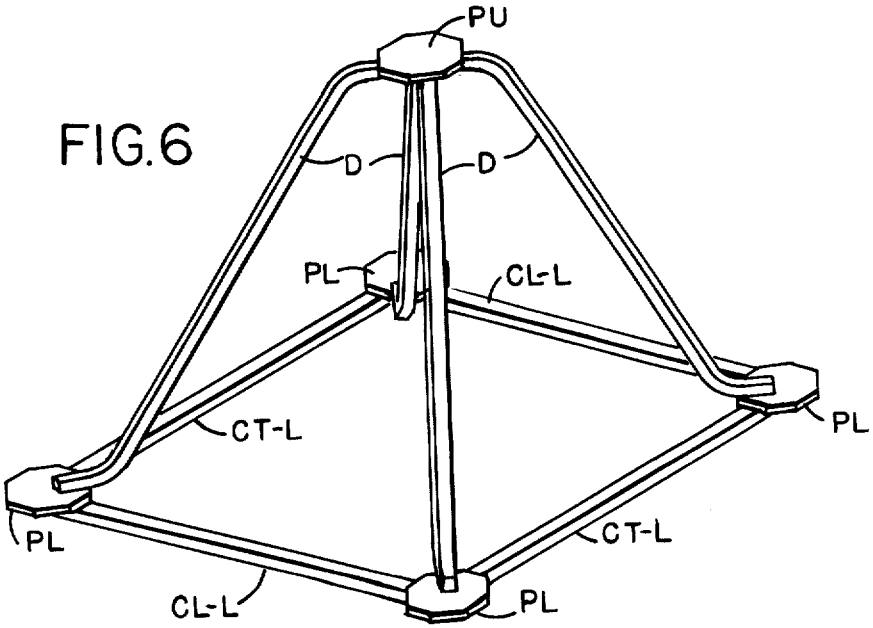
FIG. 6 is a schematic three-dimensional view of an upright module of this invention.

As can be observed more clearly in FIG. 5, two of the chord members CL-L and two of the chord members CT-L, together with interconnecting lower connector plates PL, all being in generally the same plane, form the base of the generally upright truncated pyramid. It will also be observed there that two of the chord members CL-U and two of the chord members CT-U, together with interconnecting upper connector plates PU, all being in generally the same plane, form the base of the generally inverted truncated pyramid. For the sake of clarity the elements comprising the upright pyramid are shown in solid lines, those elements comprising the inverted pyramid are shown in phantom lines; and those elements common to both pyramids are shown in both solid and phantom lines.

From FIG. 1 it will be observed that any two adjacent upright pyramidal modules are secured together by two of the base corner lower connector plates PL and by a chord member CL-U extending between the respective upper connector PU at the apexes of the pyramids.

Figure 8:
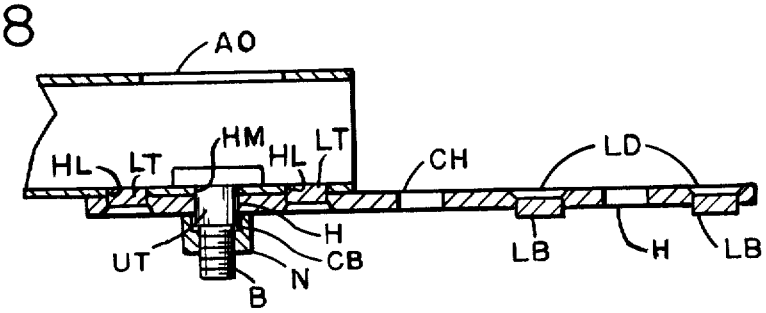
FIG. 8 is an enlarged sectional view of a distal portion of a strut member in conjunction with a connector plate of this invention together with a preferred form of securing means, with the view of the connector plate being that as taken along line 8—8 of FIG. 3.

The connector plate P is a relatively flat member, i.e., it has no angled or inclined seating planes to seat the connecting chord and web members. In a preferred form (FIG. 3) the plate P is octagonal in plan view. The plate P defines a series of holes H equally spaced radially from the center of the plate where there is also defined a center hole CH. The series of holes are also equally spaced at intervals of 45 degrees about a circle having its center coincident with the center of the plate P. Along the same radial line of each hole H are coined positioning lugs L which are adapted to accurately position a chord member or strut member to be connected. The lugs along a single radial line are disposed on the same side of the plate in respect to each other but on the opposite side of the plate in respect to the lugs along a next adjacent radial line. For convenience of description, the lugs on the top side of the plate P are designated as LT and those on the bottom side as LB (FIG. 8). In FIG. 3, the depressions which are formed in the coining of the bottom lugs LB are designated by LD. The purpose of the lugs L is to mate with corresponding holes HL in the walls of the chord members and the strut members and thus accurately position the members in respect to the connector plate and to each other. The center hole, CH may be used to secure attachment means for positioning an assembled module at the construction site.

It will be noted that the bolt receiving holes HL of the strut members D are on the exterior side of the tube section, in respect to a modular unit, and that the holes HL of the chord members C are on the interior side of the tube section, in respect to a modular unit. Likewise, the access openings AO of the strut members D are on interior side of the tube section and the openings AO of the chord members are on the exterior side of the tube section.

Figure 9:
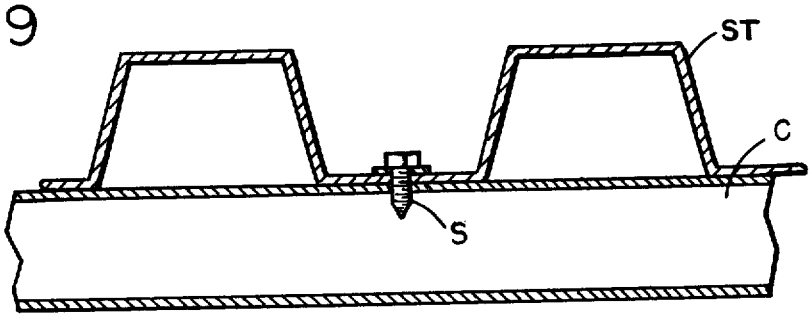
FIG. 9 is a fragmentary view of a corrugated sheeting attached to the top plane of the frame of this invention.

The positioning of the plates within a pyramidal module is such that all of the strut members D are mounted interiorly of the modular units and all of the chord members C are mounted exteriorly of the units. Consequently, a top plane is presented which is level throughout its extent and which thus facilitates the attachment of a deck or roof. Sheeting ST or other material may be secured directly to the chord members C by unskilled labor who only need to operate a powered screw driver to insert a self-tapping screw S in forming a connection as shown in FIG. 9. In contrast, in installations where open channels are used as the top chords or struts more complex fastening systems are required to secure roofing or other deck construction; for example a skilled welder may be needed to arc weld sheeting to the chord members and in other installations additional structural members, such as wooden plate members, may be required.

Figure 7:
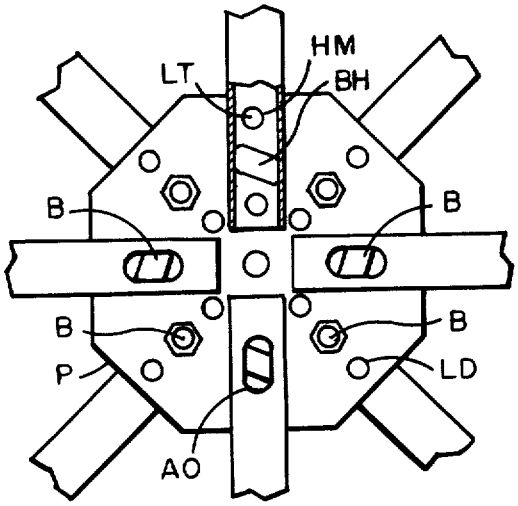
FIG. 7 is an enlarged plan view of a typical connector plate illustrating the manner in which the chord members and the diagonal strut members are connected.

In a preferred space frame arrangement, one of the connector plates P secures four chord members C and four strut members D, with each member being accurately positioned by two positioning lugs L and being fastened by a single bolt B. As may be seen in FIG. 7, the head BH of the bolt B is in an elongate form and dimensioned in respect to the inside of the tube to be secured such that upon insertion through access opening AO and after initial turning the bolt head BH will interference fit and press against the walls of the tube and cease rotating upon further tightening of the nut N. Consequently, only a single wrench or tightening tool is required for the nut. In contrast, in systems where the dimensions of the bolt head are all less than the spacing between the sidewalls of the tube, two tools are required, one to hold one of either bolt or nut, another to rotate the other of either bolt or nut. Also, an opening larger than that to merely permit insertion of the bolt head would be required in order to accommodate the holding or tightening tool. The unthreaded shank portion UT is accurately dimensioned in respect to the mounting hole HM of the tube and the corresponding hole of the connector plate H to facilitate, together with the positioning lugs, the transmission of the shear or tensile stresses.

The nut N has a counterbore portion CB adapted to receive a part of the unthreaded shank portion UT of the bolt and thus insures that upon full tightening of the nut N the corresponding chord or strut member will bear tightly against the connector plate.

In one of the preferred embodiments, designated as a five foot module, the spacing of the connector plates is five feet from center to center of the plates at the four corners of the square base of the pyramid; the height from the plane extending through the outside surface of the square base to the plane extending through the outside surface of the connector plate at the apex of the generally pyramidal form (truncated) is three feet ten inches; the tubes forming the chord and the strut members are $1\frac{5}{8}$ inches square, outside dimensions; the overall length of the tube strut along its centerline line is about $60\frac{1}{4}$ inches, with the distal straight portions each being about $3\frac{1}{2}$ inches long. It is also preferred to use an inside radius of at least 3 inches in forming the legs of the S-shape of the tube struts in order to minimize bulging and to provide a smooth curve transition from the diagonal straight length to the distal legs, which legs are in parallel planes.

The use of the strut members of this invention having a closed tube cross-section and a generally S-shaped configuration, with the distal portions being generally parallel to each other, results in a number of advantages. The thickness and/or cross-sectional dimensions of the web members may be less than that employed in web members which are of an open cross-section such as a U-shaped channel. The explanation for this is that the closed section is more resistant to twisting or torsion stresses. For example, if it be assumed for comparison purposes that the closed tube and open channel both be fabricated of 12 gauge material (0.105 thickness) and in the same square shape, 1⅝ inches on a side, the theoretical angle of twist, due to the same degree of applied torque, for the open channel would be in the order of 180 times as great as that for the closed tube. With the same dimensional and applied torque assumptions, the shear stress would be in the order of 23 times as great for the channel as it would be for the closed tube.

Further, by reason of the distal portions being in planes which are generally parallel to each other, relatively simple flat connector plates may be used. Such plates are distinct from those which are necessarily of complex configuration because of the need to match all of the different diagonal planes in which the distal portions of generally straight linear strut members converge at the connector plates forming the corners and apexes of the pyramidal units. A further advantage of the use of the flat connector plates and generally S-shaped strut members is that only one type of connector plate is required for the system. In contrast, in systems where connector plates having diagonally extending bearing seats with two positioning lugs positioned on the same face thereon, two different types of plates are required, usually designated as in-strut and out-strut connectors; the in-strut connectors having their positioning lugs on the inside faces of their angled seats and the out-strut connectors have their positioning lugs on the outside faces of their angled seats. The connector plates of this invention are also distinct and provide an advantage over connector plates having diagonally extending bearing seats with a positioning lug on each side of the plate portion forming the bearing seat. While this latter described arrangement is such that the same connector plate may be used in either the top or bottom planes, only one of the positioning lugs is used at one end of a strut member; in contrast, in this invention two positioning lugs are used at each end of a strut member to better facilitate exact positioning of the strut member between two connector plates.

The positioning of the chord members on one side of the connector plate and the diagonal strut members on the opposite side of the plate provides an arrangement wherein the twisting forces are better balanced as compared to arrangements wherein all of the members, chord and strut, are secured to the same side of the connector fixture.

A still further advantage of the system of this invention is that the height of the pyramid form need not be restricted even if the size of the base of the pyramid be maintained. Consequently, the system is more readily adapted for use in conjunction and combination with pre-existing structures. In contrast, those systems which employ structural elements which are all of the same length, including the diagonal or strut members, are limited to a fixed height. Also, those systems which employ connector plates having angled bearing seats for the strut members are also limited to a fixed height. With the present system changes in height can be accommodated simply by varying the angle and length of the straight linear portion between the distal portions of the S-shaped strut members.

What is claimed is:

1. A space frame module of generally pentahedron pyramidal configuration comprising:

a generally square base made up of four chord members arranged in a single plane and connected at their extremities to form base corners;

four strut members connected to the base corners and converging to form an apex;

said strut members being of tube cross-sectional configuration and having a substantial straight length and with smooth curve portions near their longitudinal ends with the distal portions each being in a straight section in a plane parallel to the plane of said chord members and parallel to each other, said distal portions being tubular in cross-section; said straight sections each having an access opening in an interior side of the tube section to facilitate handling of fastening means, a connector plate at each of said base corners and at said apex for connecting said chord members and said strut members to form said module; and said plate presenting coplanar bearing seats for said chord members on one face of said plate and coplanar bearing seats for said strut members on the opposite face of said plate.

2. In a space frame having (a) a plurality of spaced substantially parallel chords;

(b) a plurality of strut members arranged in pyramidal units; and (c) a connector plate at the apex of each pyramidal unit joining together the chords and the strut members forming the apex of a unit, the improvement wherein:

(1) said strut members are generally S-shaped and tubular in cross-section throughout their longitudinal extent, the distal portions of the S being tubular in cross-section, as opposed to being closed by flattening, and having on the exterior side thereof a mounting opening for receiving and mounting therein fastening means and on the interior side thereof an access opening to facilitate handling of fastening means, (2) said connector plate is generally flat and connects chords on one flat planar face thereof and strut members on the opposite flat planar face thereof, and (3) each of said chord and said strut members is independently secured to said connector plate by fastening means.

3. In combination with a connector plate and a fastening member a generally S-shaped strut member in space frame construction, said strut member being tubular in cross-section through its longitudinal extent, and with the distal portions of the S-shape being straight sections, which straight sections are parallel to each other;

each straight section having an opening in an exterior side of the tubular cross-section for receiving fastening means and an access opening in an interior side of the tubular cross-section to facilitate handling of fastening means;

said fastening member having an elongate form dimensioned in respect to the inside of said strut member such that upon insertion through said access opening and after initial turning the elongate form will interference fit and press against the wall of said strut member.

4. A space frame comprising:

(a) a plurality of chord members, (b) a plurality of strut members, and (c) a connector plate connecting said chord members and said strut members, the improvement wherein:

(1) said strut members are generally S-shaped and tubular in cross-section throughout their longitudinal extent;

(2) said connector plate connects said chord members on one face thereof and said strut members on the opposite face thereof;

(3) said strut members have an opening at their distal portions in exterior sides of their tubular cross-sections for receiving fastening means and access openings in interior sides of their tubular cross-sections to facilitate handling of fastening means.

* * * * *